United States Patent [19]

Palecek et al.

[11] 4,359,258

[45] Nov. 16, 1982

[54] ELECTRICAL CONNECTOR

[75] Inventors: Vincent J. Palecek, Cicero; B. Alan Berg, Wood Dale, both of Ill.

[73] Assignee: TRW Inc., Cleveland, Ohio

[21] Appl. No.: 111,914

[22] Filed: Jan. 14, 1980

[51] Int. Cl.[3] ..... H01R 9/09

[52] U.S. Cl. ..... 339/176 MP; 339/17 C; 339/258 R

[58] Field of Search ..... 339/17 C, 221 R, 275 B, 339/258 R, 258 A, 258 P, 64, 176 MP

[56] References Cited

U.S. PATENT DOCUMENTS

| | | | |
|---|---|---|---|
| 3,083,351 | 3/1963 | Neilsen, Jr. | 339/217 |
| 3,143,385 | 8/1964 | Zimmerman, Jr. et al. | 339/217 |
| 3,296,577 | 1/1967 | Travis et al. | 339/258 R |
| 3,390,376 | 6/1968 | Nava | 339/217 |
| 3,467,944 | 9/1969 | Hammell et al. | 339/125 |
| 3,663,931 | 5/1972 | Brown | 339/218 R |
| 3,681,741 | 8/1972 | Lichto | 339/176 |
| 3,685,001 | 8/1972 | Krafthefer | 339/258 R |
| 3,824,557 | 7/1974 | Mallon | 339/258 R |
| 3,853,389 | 12/1974 | Occhipinti | 339/258 R |
| 4,002,400 | 1/1977 | Evans | 339/258 R |

FOREIGN PATENT DOCUMENTS

| | | | |
|---|---|---|---|
| 1022113 | 3/1966 | United Kingdom | 339/258 R |

OTHER PUBLICATIONS

IBM Technical Disclosure Bulletin, "Component Mounting and Wire Wrapping Contact," H. C. Schick vol. 5 No. 5 10-1962.

*Primary Examiner*—John McQuade
*Attorney, Agent, or Firm*—Yount & Tarolli

[57] ABSTRACT

An electrical connector having a socket for receiving a male contact, and an integral solder tail which projects into an opening in a circuit board and is soldered therein. The socket includes a pair of flexible opposed beam sections projecting axially from a cylindrical base and defining therebetween a contact area for receiving and engaging a male electrical contact. The flexible opposed beam sections have respective first portions converging from the base toward the contact area and respective second portions diverging from the contact area toward distal ends which define a target area for the male electrical contact. The distal ends define a circular target area for guiding a male electrical contact into the socket. The connector includes integral, locking tabs deformable angularly and in opposite directions relative to the central axis for engaging an insulator housing to help retain the socket in a housing while accommodating relative radial deflection of the socket and the solder tail.

9 Claims, 8 Drawing Figures

ELECTRICAL CONNECTOR

BACKGROUND AND SUMMARY OF THE INVENTION

The present invention relates to electrical connector structure, particularly to an electrical connector having a socket with opposed, resilient beams for receiving and engaging a male contact, and an integral solder tail adapted to be soldered to a printed circuit board into which the solder tail projects. It also relates to structure supporting the connector in an insulator housing.

Broadly speaking, electrical connectors having sockets with opposed, resilient beams and integral solder tails are well known. They have taken many and varied forms, as shown, for example, by U.S. Pat. Nos. 3,467,944; 3,663,931 and 3,824,557. Those patents show sockets with opposed, flat sided resilient beams forming rectangular target areas for guiding male contacts into engagement therewith. They also show different types of solder tails.

Another type of electrical connector has also been manufactured by the assignee of the present invention. That connector has a socket with opposed beams defining an elliptical target area and a planar solder tail which is offset from the central axis of the socket.

The present invention is directed to an improvement in an electrical connector with a socket having resilient, opposed beams and an integral solder tail. The connector of the invention is believed to provide substantial advantages over previous such electrical connectors.

Specifically, known electrical connectors with resilient opposed beam-type sockets and integral solder tails have presented target areas for male contacts which are relatively small. Further, previous electrical connectors with resilient opposed beam-type sockets and integral solder tails have presented difficulties in terms of alignment with the male contact. This has been a particular problem when the connectors are grouped closely together in an insulator housing block and are designed to engage a plurality of closely grouped male contacts. During assembly of the solder tails with the printed circuit board the sockets can become skewed relative to their original axis, and relative to their intended alignment for receiving the male contacts. When a group of male contacts are to be inserted into the sockets, the skewed sockets may prevent the insertion of some of the male contacts into the sockets. This can prevent the efficient engagement of a group of male contacts with respective sockets.

The invention is directed to a connector with a socket formed by resilient, opposed beams and an integral solder tail, and particularly to a connector which is constructed so as to minimize problems due to misalignment of the socket with a male contact, and without any sacrifice of the effectiveness of the electrical connector between the male contact and the socket.

In a connector according to the invention the resilient, opposed beams of the socket are designed to provide a circular target area for receipt of the male contact. The invention provides a large circular target area which helps provide excellent mechanical and electrical contact performance.

Further, in the connector of the invention, the socket is movable radially and axially relative to the solder tail in order to enable the socket to move and flex relative to the solder tail to compensate for misalignment of the socket with the male contact which is to be received by the socket.

Still further, the connector of the present invention is constructed such that the socket not only mates with a misaligned male member, but also realigns with the solder tail upon removal of the male contact. Thus, the connector would be readily engageable with another male contact which is properly aligned with the socket.

The capability of the socket to flex relative to the solder tail, and realign with the solder tail is due in part to specially formed locking tabs which retain the socket in the insulator housing. The locking tabs extend in opposite angular directions relative to the central axis of the connector. The tabs have a resilient engagement with the underside of the insulator housing and function not only to retain the socket contact in the insulator housing, but also to allow the socket to float somewhat in the housing to accommodate misalignment with a male contact. Further, they provide a force which tends to center the socket contact in the insulator.

In the connector of the invention, radial flexibility of the socket relative to the solder tail is further enhanced by the fact that a relatively thin, flexible, integral interconnection, including the locking tabs, is provided between the socket and the solder tail. The socket and the solder tail, and a portion of flexible interconnection therebetween are generally coaxial, to minimize socket deformation during mating.

DESCRIPTION OF THE DRAWINGS

Further features and advantages of the present invention will be apparent to those skilled in the art to which the present invention relates upon consideration of the written description which follows taken in connection with the accompanying drawings in which.

DESCRIPTION OF THE PREFERRED EMBODIMENT

Figure 1:
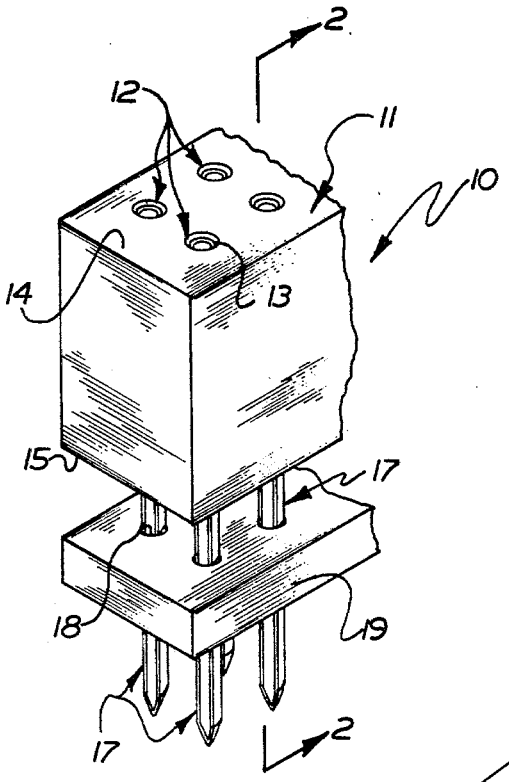
FIG. 1 is a schematic perspective view illustrating a fragmentary section of an insulator housing supporting a plurality of electrical connectors according to the invention, with solder tails projecting outwardly of the insulator housing and mounted in a printed circuit board.

As noted about, the present invention relates to an electrical connector with a socket and an integral solder tail. The connector is disclosed in FIG. 1 in a connector assembly 10.

The connector assembly 10 includes an insulator housing 11 which supports a plurality of electrical connectors 12. The connectors 12 are disposed in respective passages 13 in the insulator housing 11. The passages 13 extend through the insulating housing to form entrance openings in one side surface 14 and exit openings in an opposite side surface 15.

Each of connectors 12 includes a socket 16 disposed in the housing passage 13. Each connector has an integral portion projecting through an exit opening of the housing 11 and forming a solder tail 17 outwardly of the housing. The solder tails 17 are received in respective holes 18 in a printed circuit board 19 and are soldered therein.

The sockets 16 have entrance areas which open toward the entrance openings in side surface 14 of the insulator housing 11. As seen in FIG. 1, the connectors are normally closely grouped in the insulator housing 11. The male contacts which engage the sockets are normally also closely grouped in an identical pattern. The problem that exists with regard to providing proper connection between the male contacts and the sockets, both mechanically and electrically, is that the male contacts and the sockets may be initially misaligned as they move toward engagement with each other. The present invention is adapted to simplify and facilitate that engagement, both mechanically and electrically, even where such misalignment initially exists.

Figure 4:
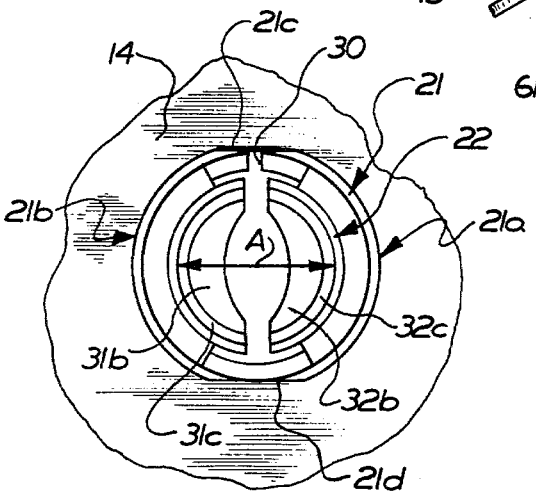
FIG. 4 is a view of the connector of FIG. 2, taken approximately along the line 4—4 of FIG. 2.
Figure 2:
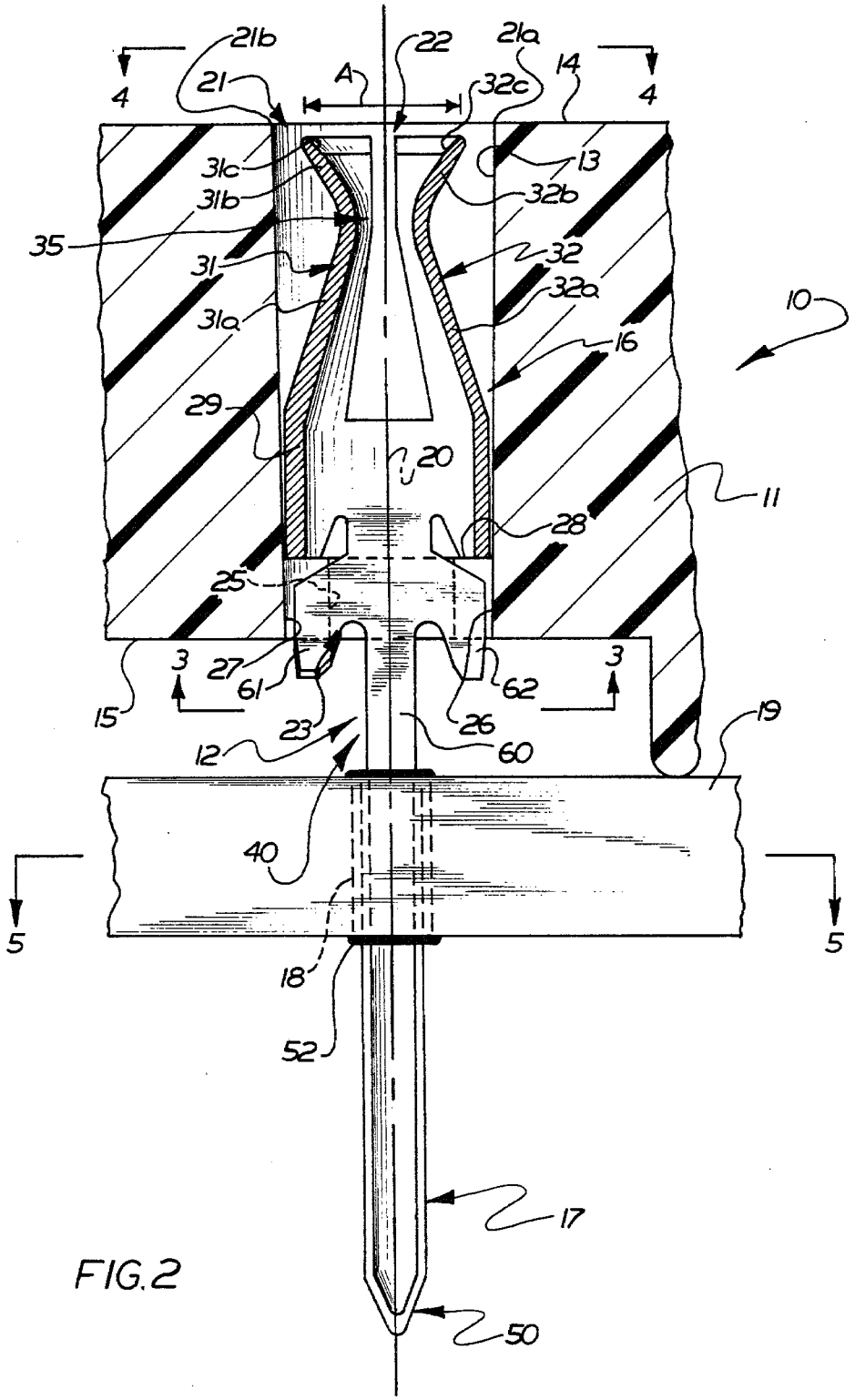
FIG. 2 is a cross sectional view, on an enlarged scale, taken along the section line 2—2 of FIG. 1.

As best shown in FIGS. 2 and 4, the socket 16 is located in the passage 13 in the insulator housing 11. The passage 13 has a longitudinal central axis 20. The passage 13 comprises an entrance opening 21 in surface 14, which has arcuate segments 21*a* and 21*b* and straight connecting segments 21*c* and 21*d*. The passage 13 then tapers from the entrance opening 21 to a circular outer periphery of a seating ledge 28. The socket has an entrance or target opening 22 adjacent, and slightly inward of, the entrance opening 21 of the housing.

Figure 3:
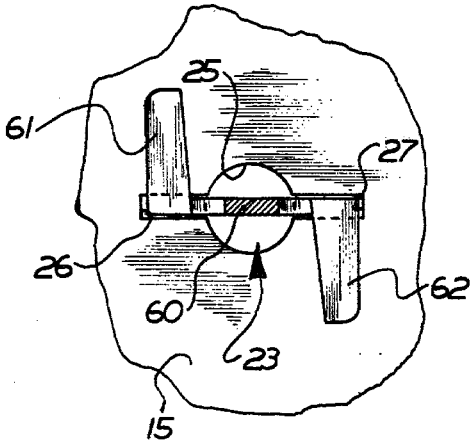
FIG. 3 is a view of the connector of FIG. 2 taken approximately along the line 3—3 of FIG. 2.

The passage 13 extends axially through the housing 11 as defined above and also includes an exit opening 23 which extends from the seating ledge 28 to the side surface 15. The connector extends through, and outward of, the exit opening 23. The exit opening 23 includes a relatively small central opening formed by circular segments 25, and diametrical opposite slots 26, 27 (see FIG. 3) for a purpose which will be described hereinbelow.

The circular segments 25 and slots 26, 27 extends from the seating ledge 28 to the exit opening 23 in the housing. As shown in FIG. 2, a cylindrical base portion 29 of the socket is bottomed on the ledge 28 and is supported thereon when the connector is assembled in the insulator housing 11.

The socket 16 of the connector is of the resilient, opposed-beam type. Specifically, the socket 16 includes the cylindrical base part or portion 29 having a central axis which, in FIG. 2, is coincident with central axis 20. The cylindrical base portion 29 has a slot 30 extending longitudinally therethrough and parallel to the central axis.

Projecting axially from the cylindrical base portion 29 is a pair of integral beam portions 31, 32. The beam portions 31, 32 flex relative to the base portion 29 upon insertion of a male contact, and resiliently engage the contact to provide a mechanical and electrical connection.

The beam portions include coaxial elliptical segments 31*a* and 32*a* which taper radially inwardly as they extend away from the cylindrical portion 29. The segments 31*a*, 32*a* taper radially inwardly to a contact area designated 35 where electrical connection with the male contact occurs. The beam portions 31, 32 further include respective coaxial elliptical segments 31*b*, 32*b* which taper radially outwardly from the contact area 35. At their distal ends, the segments 31*b*, 32*b* have circular surfaces 31*c*, 32*c* which taper radially outwardly at a greater rate than the segments 31*b*, 32*b*, and define the entrance or target opening 22 of the socket 16.

The beam portions 31, 32 are separated from each other and diametrically opposed to each other, from their respective connections with cylindrical base part 29 to their distal ends forming the target area 22. As a male contact is inserted between the beam portions 31, 32, the beam portions are deflected outwardly from the central axis of the socket, and are resiliently biased against the male contact to retain the male contact between the beam portions and establish electrical contact between the male contact and the beam portions.

In the event that the diameter of the male contact which is inserted, or attempted to be inserted, between the beam portions is too large, the beam portions 31, 32 will interfere with the tapered wall of passage 13 and thereby resist insertion of the oversized male contact into the socket.

As best shown in FIG. 4, the target area 22 formed at the distal end of the beam portions by the tapered surfaces 31*c*, 32*c* is circular. It has a diameter designated A in FIG. 4, and presents a relatively large entrance area for receipt of the male contact. Accordingly, substantial amount of misalignment of the male contact with the central axis of the socket can be accepted and still provide a physical and effective connection between the male contact and the socket. This is to be contrasted with a construction where the target area indicated by the diameter A in FIG. 4 would be elliptical in shape as has been the case with a previous socket construction.

The solder tail 17 is formed integrally with the socket 16. An integral portion of the connector, designated 40, interconnects the solder tail 17 with the socket 16.

Figure 5:
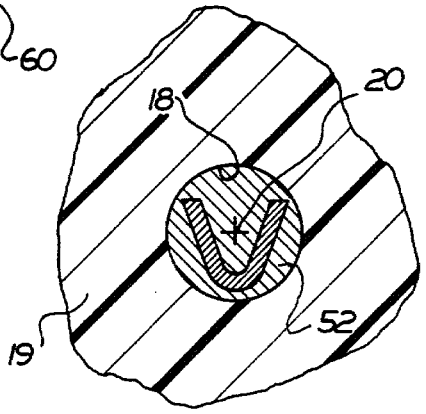
FIG. 5 is a still further view of the connector of FIG. 2 taken approximately along the line 5—5 of FIG. 2.

The solder tail 17 is outward of the housing, and has a tapered distal end 50 for facilitating insertion of the solder tail into an opening in the printed circuit board 18. The cross section of the solder tail 15 is generally V-shaped, as best shown in FIG. 5. This V-shaped configuration of the solder tail provides a substantial amount of rigidity to the solder tail.

As best shown in FIG. 5, the opening 18 in the printed circuit board is larger than the cross section of the solder tail. The solder (shown at 52) completely encircles and surrounds the solder tail 17. This provides for significant surface contact area between the solder tail and the solder in order to provide a good electrical connection between the solder tail 17 and the contact area of the printed circuit board 19.

Figure 7:
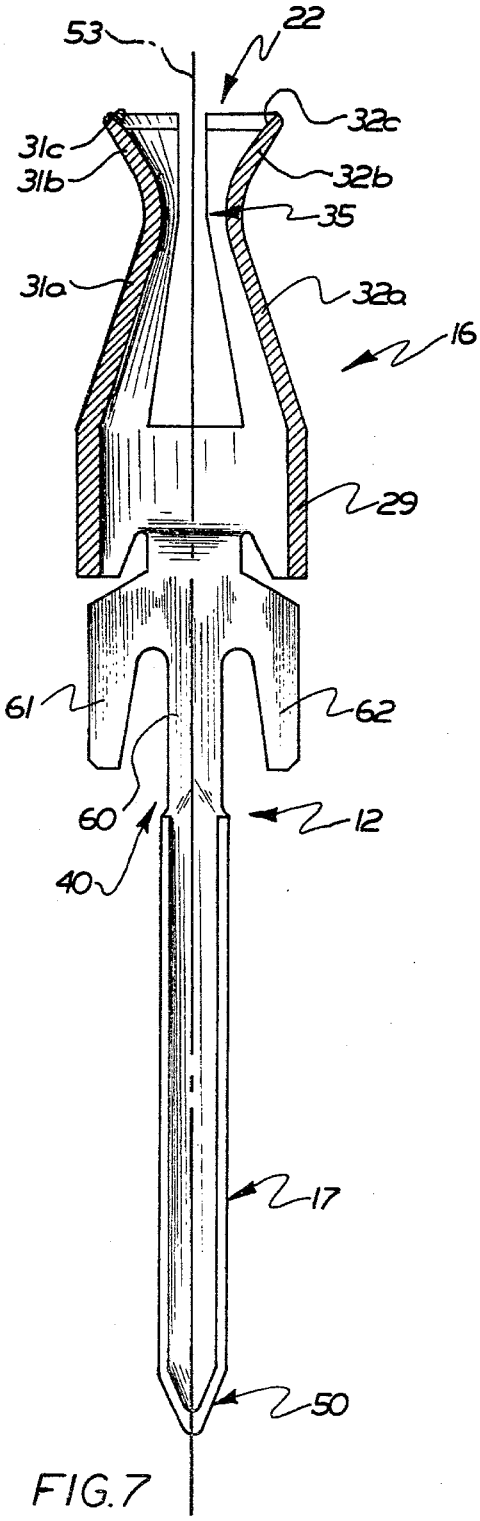
FIG. 7 is a view of the connector of FIG. 6 taken approximately along the line 7—7 of FIG. 6.
Figure 6:
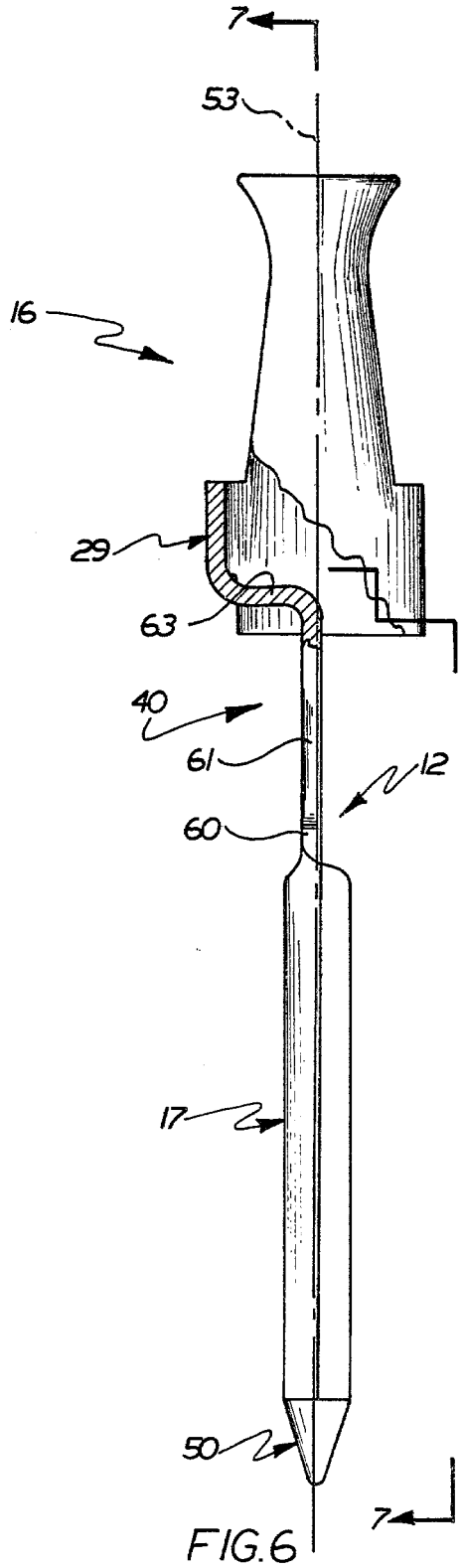
FIG. 6 is a side elevational view of the electrical connector shown in FIG. 2, prior to the assembly of the electrical connector in the insulator, with a fragmentary portion shown in section.

Referring to FIGS. 6 and 7, the solder tail 17 is generally coaxial with the central axis of the socket 16. Specifically, the central axis of the solder tail corresponds with the central axis of the socket 16. That axis is shown at 53 in FIGS. 6, 7. As stated above, when the connector is disposed in a passage 13 in the housing, the central axis 53 of the connector is ideally coincident with the central axis 20 of passage 13.

The portion 40 of the connector 12 which interconnects the socket 16 and the solder tail 17 is relatively thin, and includes a neck 60 and a pair of locking tabs 61 and 62. The neck 60 is planar and is parallel to the central axis 53 of the connector. Before being assembled in the housing, the locking tabs 61, 62 are planar and are disposed in a common plane with the neck 60 (FIGS. 6, 7). The lockng tabs 61, 62 are also on opposite sides of the central axis 53. The neck 60 and the locking tabs 61, 62 are formed integrally with the base portion 29 of the connector and are attached to the base portion by a radially extending projection or part 63.

Figure 3A:
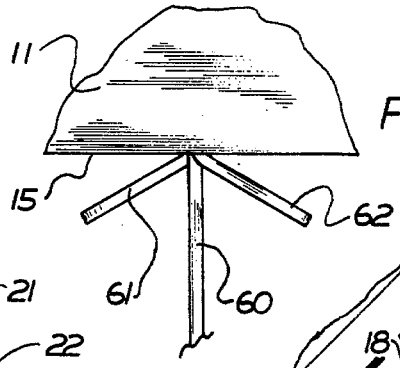
FIG. 3A is a fragmentary side elevational of the insulator housing and connector of FIG. 1, showing the angularly projecting locking tabs.

When a connector 12 is assembled in a passage 13 in the housing, the neck 60 extends through and out of the circular portion of the exit opening of the housing. The locking tabs 61, 62 extend through and out of the slots 26, 27. After insertion, the portions of locking tabs 61, 62 outwardly of the slots are bent out of their common plane in opposite angular directions and toward the housing surface 15 at the exit end of the insulator 11. The locking tabs 61, 62 have a certain degree of resilience and are retained against the housing surface 15 at acute angles thereto (see FIG. 3A). The tabs, in effect, function not only to retain the connector 12 in the insulator housing 11, but also help provide the socket with a significant amount of alignment flexibility (radially and axially) in the passages 13 of the insulator. Thus, if a male contact to be assembled with the socket 16 is misaligned with the socket 16, the socket 16 itself has a flexibility allowing it to move somewhat relative to the passages 13 to help it align with the male contact.

The neck portion 60 is narrow, and is thin in cross section. Further, the locking tabs 61, 62 are bent in opposite angular directions out of their respective plane and extend in opposite angular relation to the central axis of the socket. These features, along with the remaining structure of the connecor, help to allow the socket to flex with minimum socket deformation during mating with a misaligned male contact.

Further, upon removal of a male contact from the connector, the locking tabs 61, 62 will function to help realign the socket 16 in the passage 13.

Additionally, if the solder tail 17 is soldered in the printed circuit board in a manner that results in the socket 16 being skewed relative to the axis of the passage 13, the socket can move or flex relative to the solder tail 17 to permit proper alignment and electrical connection of the male contact with the socket 16.

As discussed above, the socket 16 can move radially relative to the solder tail portion 17 of the connector. This radial movement, of course, cannot occur without some amount of axial movement of the socket 16. The axial movement of the socket 16 is accommodated by the resilient locking tabs 61, 62. Accordingly, the socket 16 can float somewhat in the sense that it is free to move or float relative to the insulator so as to effect a proper alignment of the female socket with the male contact which it is to receive.

The larger circular target area and the floating capability of the connector of the invention is believed to make the connector capable of use in many types of electrical connector assemblies, because of its ability to establish good contact despite significant degrees of misalignment between the male contact, socket, and printed circuit board.

The connector of the invention is preferably made of a single piece of strip material. The material is preferably a copper alloy base which is nickel/gold plated in the contact areas, and which has a copper underplating totally thereover. The connector is constructed by a stamping operation, particularly a progressive die stamping operation. The various operations are performed in a progressive way in order to effect the manufacture of the connector from a single strip of material. The specific progressive die stamping operation will not be disclosed herein, since it does not form a part of the present invention.

Having described the invention, we claim:

1. An electrical connector comprising a socket and a solder tail, said solder tail including a projecting portion to be received in an opening in a circuit board and soldered therein, said socket comprising a base section having a central axis, said base section being integrally connected with said solder tail, said socket further including a pair of flexible opposed beam sections projecting axially from said base section and defining therebetween a contact area for receiving and engaging a male electrical contact, said flexible opposed beam sections having respective first portions converging from said base section toward said contact area and respective second portions diverging from said contact area toward distal ends which define a target area for the male electrical contact, said distal ends defining a circular target area for receiving the male electrical contact, connecting means integral with said base section and said solder tail, said connecting means including a planar neck portion disposed in a plane which includes said central axis, and a pair of locking tabs deformable angularly and in opposite directions relative to said central axis for engaging an insulator housing to retain said socket in the housing and accommodating relative radial deflection of said socket and said solder tail, said pair of locking tabs being planar and having an undeformed state in which they are in a common plane with said neck portion and are disposed on opposite sides of said central axis, said locking tabs being deformable angularly and in opposite directions out of said common plane and into angular relation with said central axis for engaging the insulator housing.

2. An electrical connector comprising a socket and a solder tail, said solder tail including a projecting portion to be received in an opening in a circuit board and soldered therein, said socket comprising a base section having a central axis, said base section being integrally connected with said solder tail, said socket further including a pair of flexible opposed beam sections projecting axially from said base section and defining therebetween a contact area for receiving and engaging a male electrical contact, said flexible opposed beam section having respective first portions converging from said base section toward said contact area and respective second portions diverging from said contact area toward distal ends which define a target area for the male electrical contact, said distal ends diverging radially outward from said second portions and defining a circular target area for receiving the male electrical contact, connecting means integral with said base section and said solder tail, said connecting means including a planar neck portion disposed in a plane which includes said central axis, and a pair of locking tabs deformable angularly and in opposite directions relative to said central axis for engaging an insulator housing to retain said socket in the housing and accommodating relative radial deflection of said socket and said solder tail, said pair of locking tabs being planar and having an undeformed state in which they are in a common plane with said neck portion and are disposed on opposite sides of said central axis, said locking tabs being deformable in opposite directions out of said common plane and into angular relation with said central axis for engaging the insulator housing.

3. An electrical connector comprising a socket and a solder tail, said solder tail including a projecting portion to be received in an opening in a circuit board and soldered therein, said socket comprising a base section having a central axis, said base section being integrally connected with said solder tail, said socket further including a pair of flexible opposed beam sections projecting axially from said base section and defining therebetween a contact area for receiving and engaging a male electrical contact, said flexible opposed beam sections having respective first portions converging from said base section toward said contact area and respective second portions diverging from said contact area toward distal ends which define a target area for the male electrical contact, said distal ends defining a circular target area for receiving the male electrical contact into said socket, said solder tail being generally coaxial with said socket and being V-shaped in cross section, connecting means integral with said base section and said socket, said connecting means including a planar neck portion disposed in a plane which includes said central axis, and a pair of locking tabs deformable angularly and in opposite directions relative to said central axis for engaging an insulator housing to retain said socket in the housing while accommodating relative radial deflection of said socket and said solder tail, said pair of locking tabs being planar and having an undeformed state in which they are in a common plane with said neck portion and are disposed on opposite sides of said central axis, said locking tabs being deformable in opposite directions out of said common plane and into angular relation with said central axis for engaging the insulator housing.

4. An electrical connector as defined in any of claims 1, 2 or 3 wherein said base section is generally cylindrical in shape and has a slot extending longitudinally therethrough and parallel to said central axis, and wherein said connector portion includes a radially extending segment integral with said base section and said planar neck portion.

5. An electrical connector assembly comprising an insulator housing having a passage extending therethrough from an entrance side to an exit side, a connector having a socket disposed in said passage for receiving a male contact entering the insulator housing through said entrance side thereof, said connector further including a solder tail outwardly of the passage in the insulator housing and an interconnecting section integrally connecting said socket and solder tail and projecting through said exit side of said passage in said housing, said socket comprising a base with a central axis and a pair of opposing beam sections projecting axially from said base, the portion of said interconnecting section projecting outwardly of said insulator housing including a pair of locking tabs having locking portions projecting angularly and in opposite directions from said central axis and disposed for engagement with a surface of said insulator housing at the exit side thereof, said exit side of said insulator housing including an exit opening having a circular central portion and slots projecting radially outward and in opposite directions from said circular central portion, said interconnecting section including a planar neck having said central axis, said planar neck projecting through said central opening, said locking tabs having planar portions projecting through said slots and being in a common plane with said planar neck, said locking portions of said locking tabs projecting angularly and in opposite directions from said common plane.

6. An electrical connector comprising a socket and a solder tail, said solder tail including a projecting portion to be received in an opening in a circuit board and soldered therein, said socket comprising a base section having a central axis, said base section being integrally connected with said solder tail, said socket including a pair of flexible opposed beam sections projecting axially from said base section and defining therebetween a contact area for receiving and engaging a male electrical contact, said flexible opposed beam sections having respective first portions converging from said base section toward said contact area and respective second portions comprising elliptical segments diverging from said contact area, and said opposed beam sections including respective distal end portions contiguous with said elliptical segments and diverging radially outward from said elliptical segments, said distal ends defining a circular target area for receiving the male electrical contact.

7. An electrical connector as defined in claim 6 wherein said solder tail is generally coaxial with said socket and is V-shaped in cross section.

8. An electrical connector as defined in any of claims 6 or 7 including connecting means integral with said base section, said connecting means including locking tabs deformable angularly and in opposite directions relative to said central axis for engaging an insulator housing to retain said socket in the housing while accommodating relative radial deflection of said socket and said solder tail.

9. An electrical connector assembly comprising an insulator housing having a passage extending therethrough from an entrance side to an exit side, a connector having a socket disposed in said passage for receiving a male contact entering the insulator housing through said entrance side thereof, the exit side of said insulator housing including a central exit opening and a pair of slots projecting in opposite directions from said central exit opening, said connector further including a solder tail outwardly of the passage in the insulator housing and an interconnecting section integrally connecting said socket and solder tail and projecting through said exit side of said passage in said housing, said socket comprising a base with a central axis and a pair of opposing beam sections projecting axially from said base, the portion of said interconnecting section projecting outwardly of said insulator housing including a pair of locking tabs having locking portions projecting angularly and in opposite directions from said central axis and disposed for engagement with a surface of said insulator housing at the exit side thereof, said interconnecting section including a planar neck having said central axis, said planar neck projecting through said central exit opening, said locking tabs having planar portions projecting through said slots and being in a common plane with said planar neck, said locking portions of said locking tabs projecting angularly and in opposite directions from said common plane.

* * * * *